US010193237B1

(12) United States Patent
Brigham

(10) Patent No.: US 10,193,237 B1
(45) Date of Patent: Jan. 29, 2019

(54) MULTI-FIN FLARED RADIATOR

(71) Applicant: Massachusetts Institute Of Technology, Cambridge, MA (US)

(72) Inventor: Glenn A. Brigham, Chelmsford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/696,351

(22) Filed: Sep. 6, 2017

(51) Int. Cl.
*H01Q 13/08* (2006.01)
*H01Q 21/06* (2006.01)

(52) U.S. Cl.
CPC ..... *H01Q 21/064* (2013.01); *H01Q 13/08* (2013.01); *H01Q 13/085* (2013.01); *H01Q 21/06* (2013.01); *H01Q 21/061* (2013.01)

(58) Field of Classification Search
CPC .... H01Q 13/085; H01Q 21/064; H01Q 13/08; H01Q 21/06; H01Q 21/061
See application file for complete search history.

(56) References Cited

U.S. PATENT DOCUMENTS 3,975,733 A * 8/1976 Bogner ..... H01Q 13/20 343/770
5,973,653 A 10/1999 Kragalott et al.
6,891,511 B1 5/2005 Angelucci
8,350,737 B2 1/2013 Sanduleanu et al.
8,736,504 B1 5/2014 West et al.
2002/0180655 A1 12/2002 Mohuchy et al.
2005/0007286 A1* 1/2005 Trott ..... H01Q 13/085 343/770
2008/0211726 A1 9/2008 Elsallal et al.
2011/0057852 A1 3/2011 Holland et al.
2013/0176186 A1 7/2013 Yaccarino et al.
2013/0214980 A1 8/2013 Lambert et al.
2014/0218251 A1 8/2014 Waschenko et al.

OTHER PUBLICATIONS

International Search Report and Written Opinion dated Nov. 9, 2017 in co-pending PCT application No. PCT/US17/18906.
International Search Report and Written Opinion dated May 23, 2018 in corresponding PCT application No. PCT/US2017/050165.

* cited by examiner

*Primary Examiner* — Hoang Nguyen
(74) *Attorney, Agent, or Firm* — Nields, Lemack & Frame, LLC

(57) ABSTRACT

In one embodiment, the present disclosure describes a flared antenna where the upper portions of the prongs are separated into a plurality of spaced apart parallel fins. The parallel fins disposed on the energized prong are energized by a common electrical feed, such as a coaxial transmission line that enters the energization region of the energized prong. The use of separate fins allows a wider range of tuning to gain greater BW and scan performance for a given equivalent design, since each fin pair may be designed independently from the other fin pairs in that flared antenna. The flared antenna may be a Vivaldi antenna, a stepped notch antenna or some other flared shape.

19 Claims, 7 Drawing Sheets

MULTI-FIN FLARED RADIATOR

This invention was made with Government support under Contract No. FA8721-05-C-0002, awarded by the U.S. Air Force. The government has certain rights in the invention.

FIELD

This disclosure relates to notch, tapered, and flared slot radiating antennas, and more particularly to multi-fin radiating antennas.

BACKGROUND

Array antennas are used for a variety of different applications. Array antennas may be constructed using a plurality of three-dimensional (3D) antennas. These arrays are typically configured as a rectangular lattice but other geometries are also possible. Additionally, these antennas may be used separately, and not as part of an array. In certain embodiments, the 3D antennas may comprise notch antenna elements. The term "notch antenna" is intended to include tapered and flared elements, such that the shape is not limited by this disclosure.

Each notch antenna element includes an electrically conductive body, referred to as a notch radiator element, which has a slot. The slot separates the notch radiator element into two prongs. One of the prongs may be grounded while the other prong is energized by an RF signal. In general, the energized prong conveys energy from a feed port into free space or air, or visa-versa. The feed port may have a characteristic impedance relative to the system impedance for maximum power transfer. The propagating signal leaving the feed port is in communication with the tuned gap between the energized prong and the other prong. This gap is optimized with other dimensions to result in wideband operation. The propagating signal conveys energy into the notch slot and then into free space or air. The antenna feed port may convey energy to and from the antenna system at its characteristic impedance. Between this feed port and the radiating element are a variety of possible architectures creating a characteristic impedance match over the desired operational frequency band. For example, in certain embodiments, a PC board may be used to carry the propagating signal. In other embodiments, a PC board may not be used.

These notch antennas may be combined to form ultra-wideband array systems. Ultra-wideband low loss phased array systems are desired in the cellular, telemetry and military applications. Use of this technology in these areas allow greater flexibility in achieving compact, lower cost, higher performance designs.

FIG. 1 shows one such notch antenna that may be used as part of an ultra-wideband array system. In this figure, a portion of an ultra-wideband array system is shown. The ultra-wideband array system extends in two dimensions, and FIG. 1 represents a periodic unit cell 1 of that ultra-wideband array system. The unit cell includes two notch antennas, one disposed on each of the front sides of the unit cell. The back facing sides contain the remaining portion of the front element sides of adjacent unit cells, making up 2 dual polarized elements in an infinite array configuration for electromagnetic (EM) modeling.

As described above, each notch antenna 10 includes an energized prong 11 and a grounded prong 12. The energized prong 11 and the ground prong 12 are separated by a slot 14. Each of these prongs is shared by two notch antennas, disposed on two orthogonal sides of the unit cell 1. An electrical feed, such as a coaxial transmission line 13, passes through the lower portion of the grounded prong 12, and enters the energized prong 11. This coaxial transmission line 13 may be carrying a RF signal to the energized prong 11. To insure proper operation, a coaxial transmission line 13 is used to convey energy between the radiating element and an input feed port. A dielectric insert may or may not be used in the coaxial transmission line 13. The antenna bandwidth (BW) and performance is a function of the total geometry including the size and shape of the slot 14. In this embodiment, the slot 14 comprises three different gap widths, with the smallest gap being at the bottom and the largest gap being at the top. The geometry of the slot 14 and the characteristics of the RF signal are some of the variables that may be tuned in creating the optimal ultra-wideband array system.

Therefore, it would be beneficial if there were a notch antenna that could have a greater range of impedance tuning, resulting in a wider bandwidth for a given height. Further, it would be advantageous if this system was also cost effective, robust, relatively easy to manufacture, and retained a lower profile.

SUMMARY

In one embodiment, the present disclosure describes a flared antenna where the upper portions of the prongs are separated into a plurality of spaced apart parallel fins. The parallel fins disposed on the energized prong are energized by a common electrical feed, such as a coaxial transmission line that enters the energization region of the energized prong. The use of separate fins allows a wider range of tuning to gain greater BW and scan performance for a given equivalent design, since each fin pair may be designed independently from the other fin pairs in that flared antenna. The flared antenna may be a Vivaldi antenna, a stepped notch antenna or some other flared shape.

According to one embodiment, a flared antenna is disclosed. The flared antenna comprises a grounded prong; and an energized prong, wherein the grounded prong and the energized prong each comprise a plurality of fins. In certain embodiments, the grounded prong and the energized prong each comprise a lower portion and an upper portion, wherein the lower portion of the grounded prong and the lower portion of the energized prong are separated by a cavity, and wherein the energized prong protrudes horizontally over the grounded prong to form a horizontal gap. In certain embodiments, all of the fins in the energized prong are energized by a common electrical feed. The flared antenna may be a notch antenna or a Vivaldi antenna.

According to another embodiment, a multi-fin flared antenna is disclosed. The multi-fin flared antenna comprises a grounded prong having a lower portion and an upper portion; an energized prong having a lower portion and an upper portion; a cavity disposed between the lower portion of the grounded prong and the lower portion of the energized prong; a horizontal gap formed by a horizontal protrusion of the energized prong over the grounded prong; wherein a top of the horizontal gaps forms a boundary between the lower portion and the upper portion of the grounded prong and between the lower portion and the upper portion of the energized prong; and a slot between the upper portion of the grounded prong and the upper portion of the energized prong; wherein the upper portion of the grounded prong comprises a plurality of spaced apart parallel grounded fins; and wherein the upper portion of the energized prong comprises a plurality of spaced apart parallel energized fins.

In some embodiments, an electrical feed passes through an opening in the lower portion of the grounded prong, traverses the horizontal gap and is in electrical communication with the upper portion of the energized prong. In certain embodiments, the electrical feed contacts an energization region of the energized prong and all of the plurality of energized fins are connected to the energization region.

According to another embodiment, a multi-fin flared antenna is disclosed. The multi-fin flared antenna comprises a grounded prong having a lower portion and an upper portion; an energized prong having a lower portion and an upper portion; a slot between the upper portion of the grounded prong and the upper portion of the energized prong; wherein the upper portion of the grounded prong comprises a plurality of spaced apart parallel grounded fins and the upper portion of the energized prong comprises a plurality of spaced apart parallel energized fins. In certain embodiments, a grounded fin and a corresponding energized fin comprise a fin pair, and a sub-slot is associated with each fin pair. The sub-slot may comprise a plurality of steps, each step having a height and a width. In some embodiments, a sub-slot associated with a first fin pair is different from a second sub-sot associated with a second fin pair. In certain embodiments, the height of the first fin pair is different from the height of a second fin pair.

BRIEF DESCRIPTION OF THE DRAWINGS

For a better understanding of the present disclosure, reference is made to the accompanying drawings, which are incorporated herein by reference and in which.

DETAILED DESCRIPTION

The present disclosure describes a multi-fin radiator which may be used as a notch, flared, or Vivaldi antenna.

Figure 1:
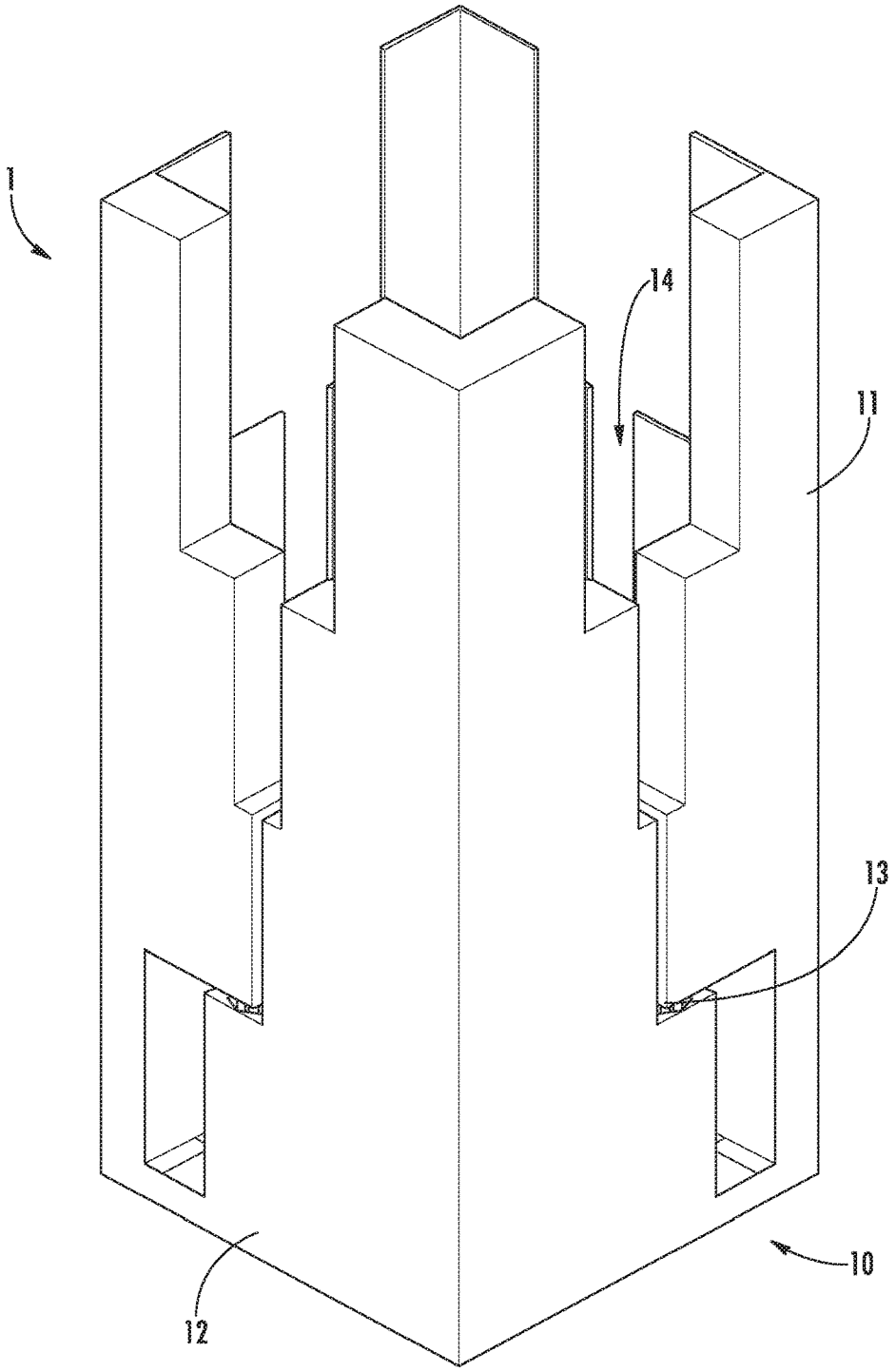
FIG. 1 PRIOR ART
FIG. 1 shows a notch antenna of the prior art.
Figure 2A:
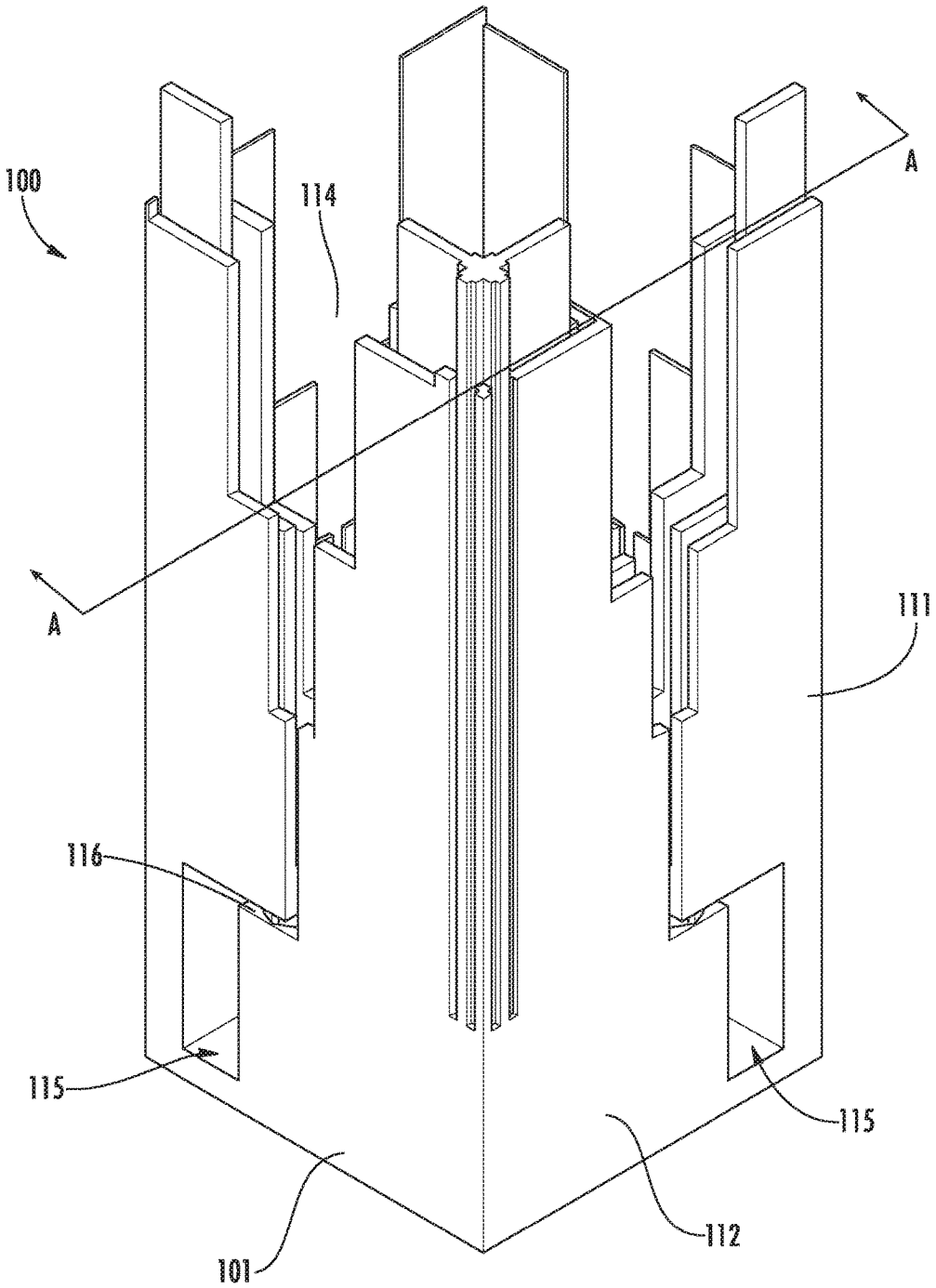
FIG. 2A shows the multi-fin flared antenna according to one embodiment, oriented in the same manner as that of FIG. 1.
Figure 4:
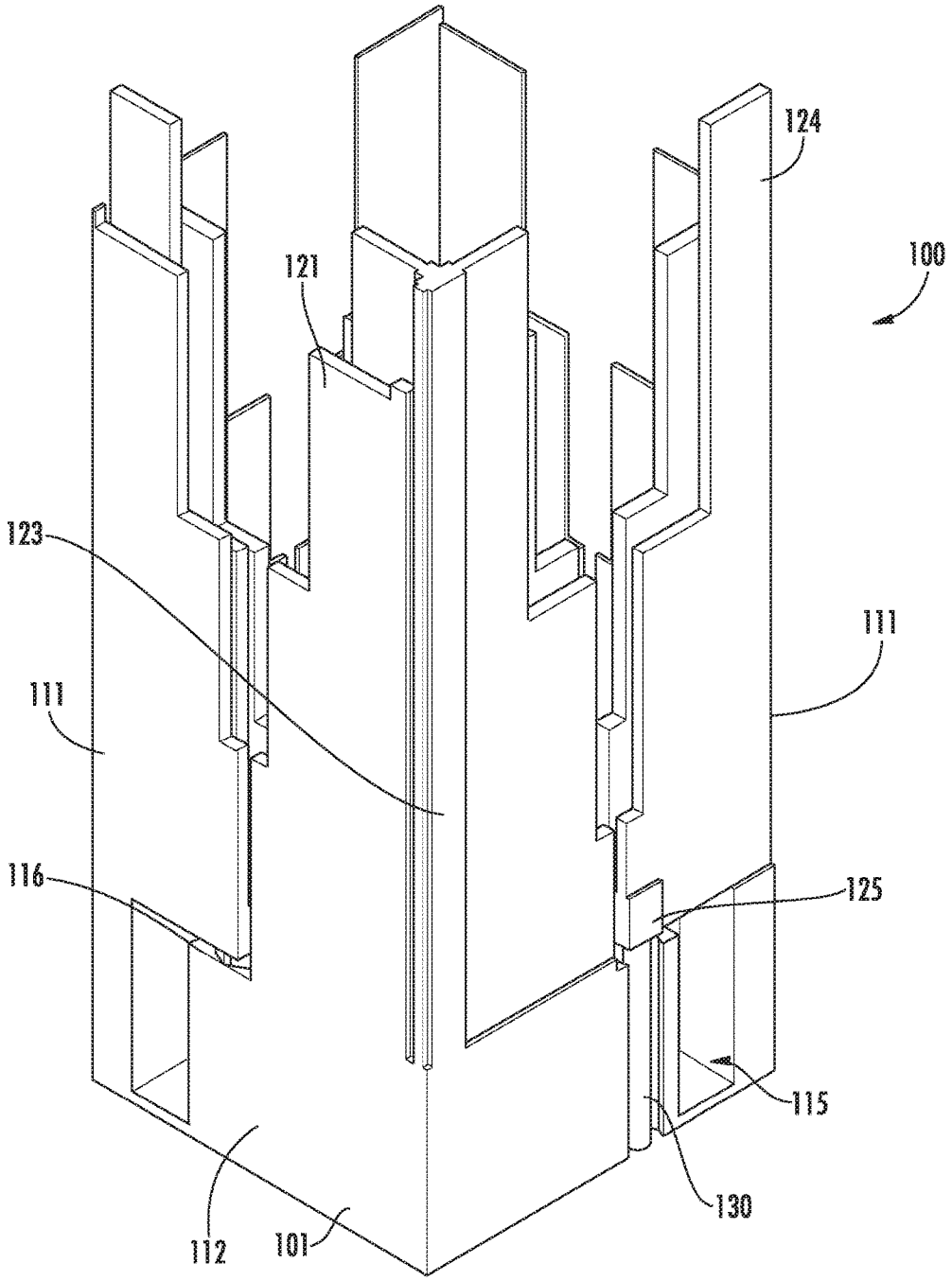
FIG. 4 shows a second cross section of the multi-fin flared antenna of FIG. 2A.
Figure 5:
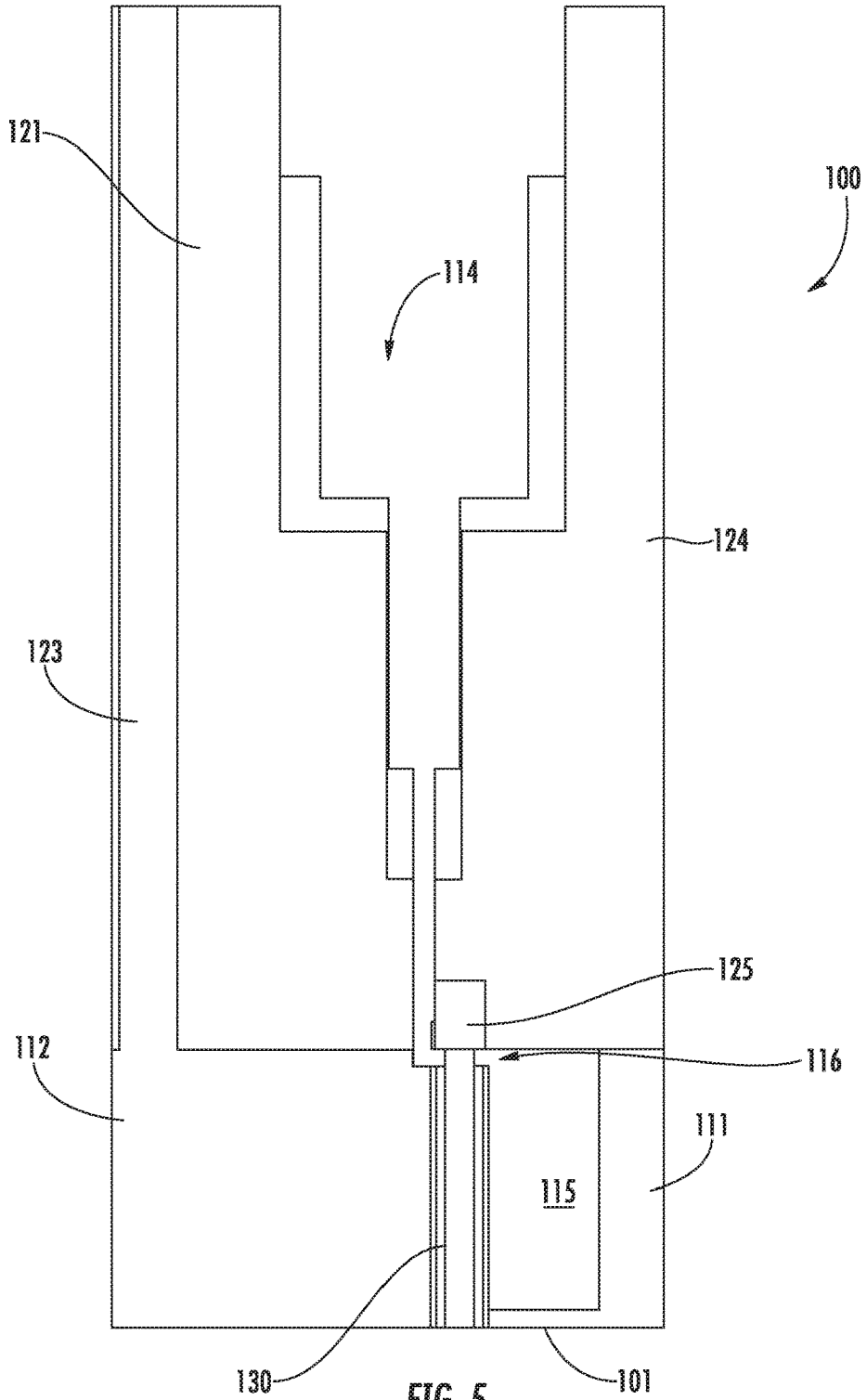
FIG. 5 shows a front view of the cross-section of FIG. 4.

FIG. 2A shows the multi-fin flared antenna 100 according to one embodiment. This figure allows ready comparison to the notch antenna shown in FIG. 1. FIG. 4 shows a cross-section of the multi-fin flared antenna 100 of FIG. 2A taken at line A-A. FIG. 5 shows a front view of the cross-section of FIG. 4.

The multi-fin flared antenna 100 includes a base 101, from which the energized prong 111 and the grounded prong 112 extend upward in the height direction. Directly above the base 101, the energized prong 111 and the grounded prong are separated by a cavity 115. At the top of the cavity 115, the energized prong 111 protrudes horizontally so as to extend over a portion of the grounded prong 112. The portion of each prong below the top of the cavity 115 is referred to as the "lower portion" throughout this disclosure. In certain embodiments, the lower portion of the energized prong 111 and the lower portion of the grounded prong 112 may be considered part of the base 101. A horizontal gap 116 is formed between the upper surface of the lower portion of the grounded prong 112 and the lower surface of the portion of the energized prong 111 that extends over the lower portion of the grounded prong 112.

As best seen in FIGS. 4-5, an electrical feed, such as a coaxial transmission line 130 having a center conductor, passes through a bore in the base 101 and lower portion of the grounded prong 112, and enters the energized prong 111. The center conductor of the coaxial transmission line 130 is sized such that it does not contact the interior walls of the bore. In other words, the center conductor of the coaxial transmission line 130 is smaller in diameter than the inner diameter of the bore on the lower portion of the grounded prong 112. In certain embodiments, the center conductor of the coaxial transmission line 130 is separated from the interior walls of bore by air. In other embodiments, a dielectric material may be disposed around the center conductor of the coaxial transmission line 130 to ensure that it is electrically insulated from the interior walls of the bore, giving a higher power capability at the feed. The distal end of the center conductor of the coaxial transmission line 130 enters a portion of the energized prong 111 referred to as the energization region 125. In one embodiment, the center conductor of the coaxial transmission line 130 is threaded and is screwed into the energization region, which may also be threaded in this embodiment. In another embodiment, the center conductor of the coaxial transmission line 130 is press-fit, soldered, welded, or otherwise affixed into the energization region. While a coaxial transmission line 130 is described, other means for carrying the RF signal through the lower portion of the grounded prong 112 to the energized prong 111 may be used.

The proximal end of the center conductor of the coaxial transmission line 130 may, in certain embodiments, pass through, connect, interface of transition to a PC board (not shown) and terminate in a feed port. In other embodiments, the feed port may be disposed on the base 101.

Comparing FIG. 2A to FIG. 1, it is seen that the multi-fin flared antenna 100 is identical to the prior art antenna with respect to the base and the lower portions of the prongs. In other words, both include a base, and a lower portion of the grounded prong, and a lower portion of the energized prong. Further, in both embodiments, the prongs which are separated by a cavity and a horizontal gap. Additionally, both include an electrical feed that passes through the grounded prong to the energized prong.

However, as is readily seen in FIG. 2A, the upper portions of the prongs are completely different. The "upper portion" is defined as that portion of each prong above the horizontal gap 116. Thus, the "upper portion" is that part of the prong which is not part of the "lower portion". Instead of having solid upper portions, the prongs in FIG. 2A comprise a plurality of fins. The fins of a prong are parallel to one another and are parallel to the front surface of the antenna. In other words, FIG. 2A shows two different notch antennas; one on the left-facing surface and one on the right-facing surface. The prongs are configured so that the fins of each prong on the left-facing surface are parallel to that surface and the fins of each prong on the right-facing surface are parallel to the right-facing surface.

Stated differently, the horizontal gap 116 has a height defined as the space between the lower surface of the energized prong 111 and the upper surface of the lower portion of the grounded prong 112. Further, the lower portion of the energized prong 111 and the lower portion of the grounded prong 112 are separated by a cavity 115 in the width direction. Similarly, the upper portion of the grounded prong 112 and the upper portion of the energized prong 111 are separated by a slot 114 in the width direction. The depth direction of a notch antenna is defined as the direction that is orthogonal to the width direction and the height direction. Each fin in the upper portions of the prongs lies in the width-height plane. These fins are arranged with spaces between them in the depth direction.

Figure 2B:
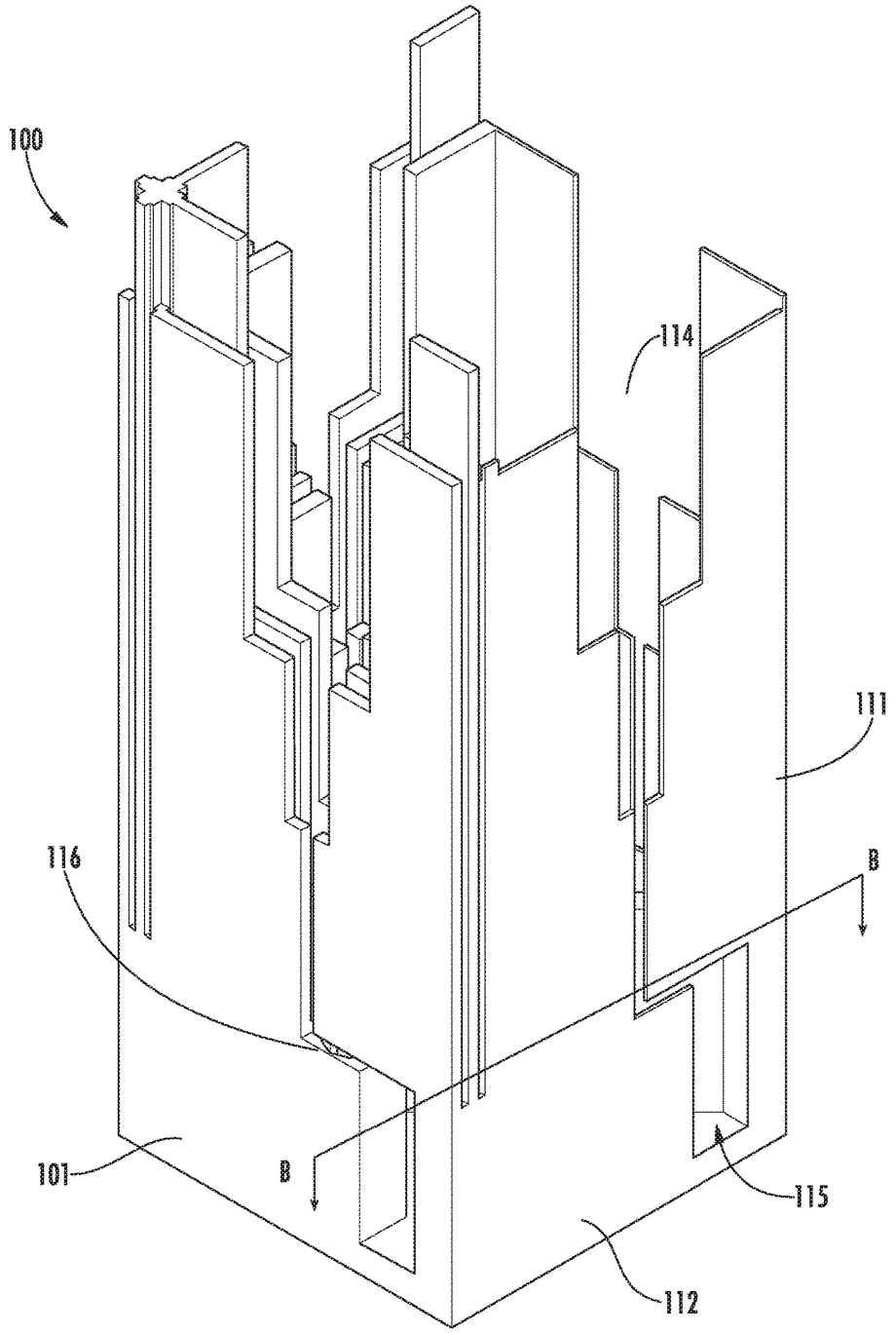
FIG. 2B shows the multi-fin flared antenna of FIG. 2A rotated one quarter turn.
Figure 3:
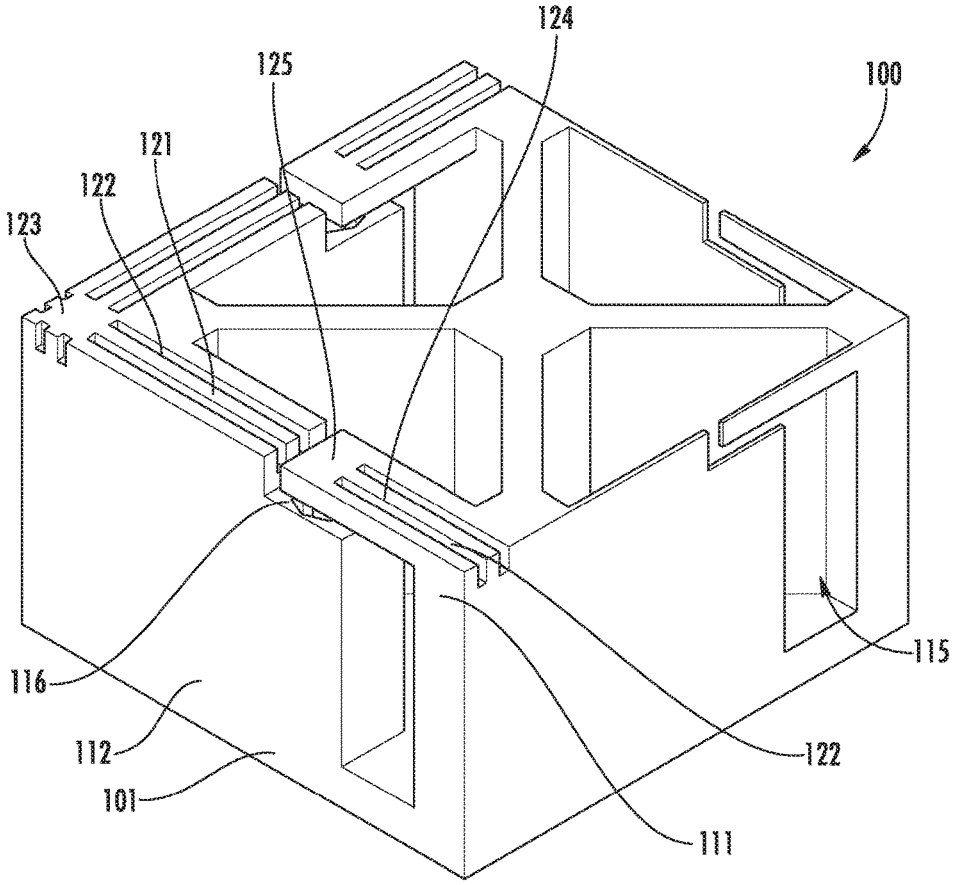
FIG. 3 shows a cross section of the multi-fin flared antenna of FIG. 2B.

FIG. 2B shows the multi-fin flared antenna 100 of FIG. 2A rotated 90°. FIG. 3 shows a cross-section of the multi-fin flared antenna 100 of FIG. 2B taken along line B-B just above the lower portions of the prongs.

The upper portion of the grounded prong 112 is segmented into several grounded fins 121, where each grounded fin 121 is separated by a spacing 122. The separation of the upper portion of the grounded prong 112 into fins may begin at a height equal to the height of the surface of the energized prong 111 that forms the top surface of the horizontal gap 116. In other words, the spacings 122 may extend upward to the top of the grounded prong 112 from this height. FIG. 5 shows the grounded fins 121 extending upward from a height that is equal to the top surface of the horizontal gap 116. In other words, FIG. 5 shows that the fins exist in the entirety of the upper portion of the grounded prong 112. In other embodiments, the separation may begin at a height higher than that defined above, such that a part of the upper portion of the grounded prong 112 does not have fins.

As can be seen from FIGS. 3-5, the grounded fins 121 of the grounded prong 112 may not be completely separate. The grounded fins 121 on the upper portion of the grounded prong 112 may meet at a vertical post 123. The vertical post 123 extends upward from the lower portion of the grounded prong 112 and is disposed a distance from the horizontal gap 116 and the slot 114. This vertical post 123 may serve to provide structural support to the grounded fins 121 of the grounded prong 112. As seen in FIGS. 3-5, the grounded fins 121 are all connected along their bottom edge to the lower portion of the grounded prong 112.

The upper portion of the energized prong 111 is also segmented into a plurality of energized fins 124 separated by spacings 122. The energized prong 111 may also be separated into fins at the height defined by the top surface of the horizontal gap 116. Thus, the spacings 122 begin at this height and extend to the top of the energized prong 111, thereby forming the energized fins 124. In other words, the entirety of the upper portion of the energized prong 111 may comprise energized fins 124. However, in other embodiments, the separation may begin at a height higher than that defined above, such that a part of the upper portion of the energized prong 111 does not have fins. The energized fins 124 are all attached along their lower edge to the lower portion of the energized prong 111. Further, the energized fins 124 may all connect to a vertical post disposed in the upper portion of the energized prong 111. In some embodiments, the vertical post 123 associated with a grounded prong 112 may also serve as the vertical post for the adjacent energized prong 111, since the unit cells are attached in a periodic pattern in the width and depth directions. Such a vertical post serves to provide structural support and electrical truncation to the energized fins 124. This vertical post is disposed away from the slot 114.

Additionally, the energized fins 124 are all attached to the energization region 125 of the energized prong 111. As explained above, an electrical feed, such as a coaxial transmission line 130, passes through the horizontal gap 116 and enters the upper portion of the energized prong 111. The electrical feed enters the upper portion of the energized prong 111 at the energization region 125. This energization region 125 is disposed directly above the horizontal gap 116, at the free end of the energized prong 111 nearest the slot 114. As noted, all energized fins 124 are attached to the energization region 125. This insures that the energy provided by the electrical feed is distributed to all of the energized fins 124.

Except for the energization region 125 and the vertical post, the energized fins 124 may be completely separate.

Further, while the figures show three grounded fins 121 and three energized fins 124, the disclosure is not limited to this embodiment. Rather, there may be any number of fins, where the number of fins is at least two.

Furthermore, in many embodiments, the number of grounded fins 121 exactly equals the number of energized fins 124, such that for each grounded fin 121 there is a corresponding energized fin 124. A grounded fin 121 and its corresponding energized fin 124 may be referred to as a fin pair. Each fin pair may have the same thickness. Further, the width of the spacings on each side of a fin pair may be the same.

In some embodiments, all of the grounded fins 121 and all of the energized fins 124 are the same thickness. In certain embodiments, all spacings 122 may be the same size. In other embodiments, dimensions are only matched for a fin pair. In certain embodiments, the thickness of each fin pair may different from at least one other fin pair.

The space between the upper portion of the grounded prong 112 and the upper portion of the energized prong 111 defines the slot 114. As is shown in FIG. 1, the width of the slot traditionally varies as a function of height, where the slot 114 may be wider at the top than at the region close to the horizontal gap. In certain embodiments, the slot 114 is defined by a plurality of steps, which differ in width. Thus, the slot 114 may be defined by the number of steps, the height of each step and the width of the slot 114 for that step.

Figure 6:
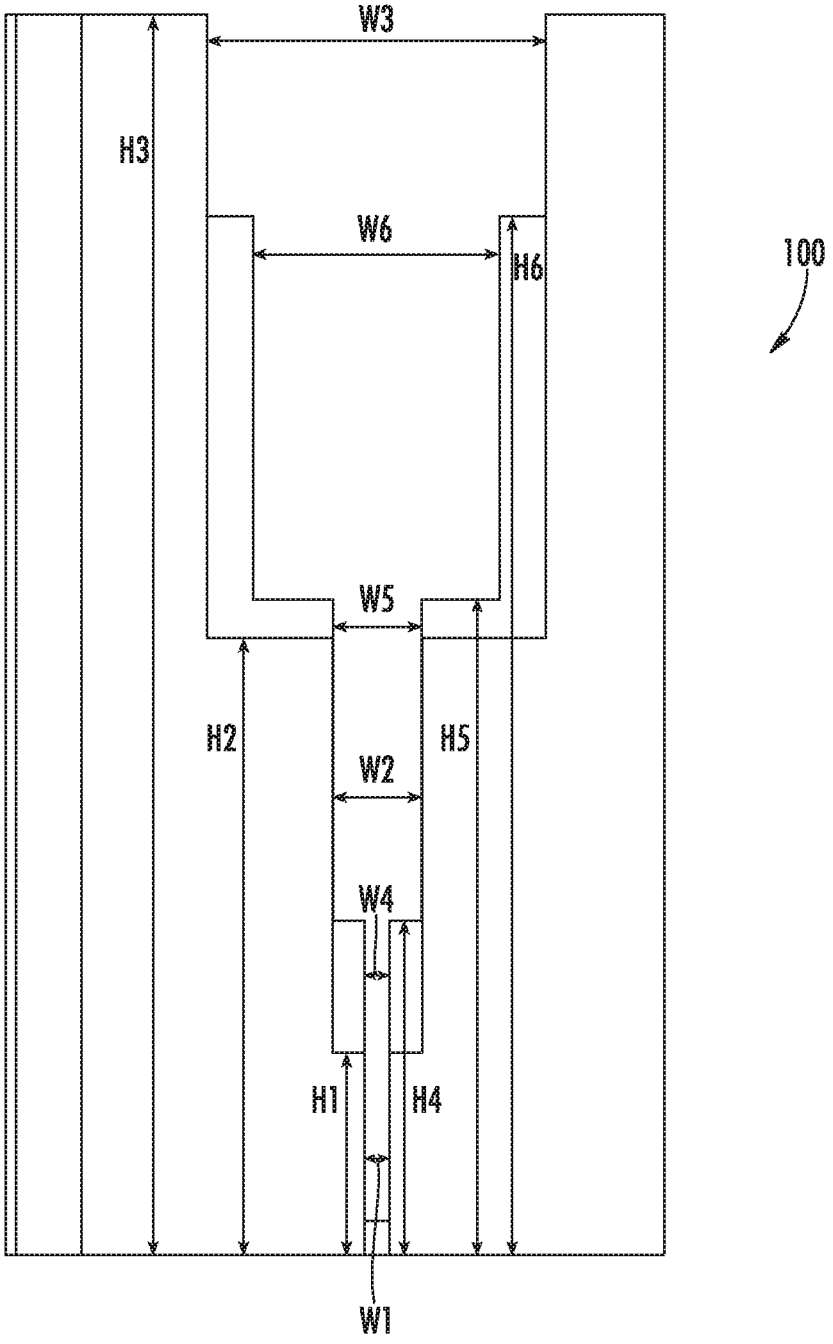
FIG. 6 shows the steps of the fins for the multi-fin flared antenna of FIG. 5.

Advantageously, the use of fins allows a plurality of sub-slots to be defined. Specifically, each fin pair defines a unique sub-slot therebetween. These unique sub-slots may differ from each other. FIG. 6 shows the same view as FIG. 5 but only shows the upper portion of the prongs so that only the fin pairs are visible. Each fin pair includes three steps. The first fin pair is defined as follows. The first step begins at the top of the horizontal gap 116 and extends upward for a height of H1. The first step has a width of W1. The second step begins at height H1 and extends to height H2. Its width in W2. Finally, the third step begins at height H2 and extends to height H3, and has a width of W3. Thus, the heights H1, H2 and H3, and the widths W1, W2 and W3 define the sub-slot associated with the first fin pair.

The second fin pair is defined as follows. The first step begins at the top of the horizontal gap 116 and extends upward for a height of H4. The first step has a width of W4. The second step begins at height H4 and extends to height H5. Its width in W5. Finally, the third step begins at height H5 and extends to height H6, and has a width of W6. Note the fin pairs do not need to have the same final heights. Further, the widths of the steps for each fin pair may be different than other fin pairs. Thus, the heights H4, H4 and H6, and the widths W4, W5 and W6 define the sub-slot associated with the second fin pair.

Note that the heights H1, H2, H3 of the first fin pair may or may not be the same as the heights H4, H5, H6 of the second fin pair. Similarly, the widths W1, W2, W3 of the first fin pair may or may not be the same as the widths W4, W5, W6 of the second fin pair.

Additionally, while FIG. 6 shows both fin pairs as having 3 steps, the disclosure is not limited to this embodiment. The fin pairs may have any number of steps. Further, each fin pair may have a different number of steps.

The fins may be fabricated in a number of ways. For example, additive manufacturing or machining may be used.

In the case of additive manufacturing, this technique uses a selected type of material and processing to create a 3D model in a plastic type or metal type material. Some Computer Numerical Control (CNC) operations may then be applied post process to correct for dimensional tolerance and surface finish limitations. For a non-conductive material, a conductive coating or plating may be applied to the model for low loss EM radiation.

In the case of machining, Electrical Discharge Machining (EDM) with CNC is applied to billet aluminum to machine the block to the size and shape needed to begin the 3D contouring. A series of steps including EDM of one or more types, which may be performed along one or more axis, is then performed. Within this process, CNC machining is used for preliminary, interim machining and completeness. There may be material heat treating in this process to correct material behavior. Depending on loss requirements and piece cost, a variety of conductive coatings can be applied. Coatings are dual purpose in corrosion inhibiting and low loss EM conduction.

While the figures show an antenna having a number of discrete steps, the concept of a multi-fin antenna may be applied to other types of flared antennas. For example, the curvature of each fin pair may differ in a multi-fin Vivaldi antenna.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A flared antenna, comprising:

a grounded prong; and an energized prong, wherein the grounded prong and the energized prong each comprise a plurality of fins, and wherein the grounded prong and the energized prong each comprise a lower portion and an upper portion, wherein the lower portion of the grounded prong and the lower portion of the energized prong are separated by a cavity, and wherein the energized prong protrudes horizontally over the grounded prong to form a horizontal gap.

2. The flared antenna of claim 1, wherein the upper portion of the grounded prong and the upper portion of the energized prong each comprise the plurality of fins.

3. The flared antenna of claim 1, wherein all of the fins in the energized prong are energized by a common electrical feed.

4. The flared antenna of claim 1, wherein the flared antenna comprises a notch antenna.

5. The flared antenna of claim 1, wherein the flared antenna comprises a Vivaldi antenna.

6. A multi-fin flared antenna, comprising:

a grounded prong having a lower portion and an upper portion;

an energized prong having a lower portion and an upper portion;

a cavity disposed between the lower portion of the grounded prong and the lower portion of the energized prong;

a horizontal gap formed by a horizontal protrusion of the energized prong over the grounded prong; wherein a top of the horizontal gaps forms a boundary between the lower portion and the upper portion of the grounded prong and between the lower portion and the upper portion of the energized prong; and a slot between the upper portion of the grounded prong and the upper portion of the energized prong;

wherein the upper portion of the grounded prong comprises a plurality of spaced apart parallel grounded fins; and wherein the upper portion of the energized prong comprises a plurality of spaced apart parallel energized fins.

7. The multi-fin flared antenna of claim 6, further comprising an electrical feed passing through an opening in the lower portion of the grounded prong, traversing the horizontal gap and in electrical communication with the upper portion of the energized prong.

8. The multi-fin flared antenna of claim 7, wherein the electrical feed contacts an energization region of the energized prong and all of the plurality of energized fins are connected to the energization region.

9. The multi-fin flared antenna of claim 6, further comprising a vertical post extending upward from the lower portion of the grounded prong, wherein the grounded fins are all connected to the vertical post.

10. The multi-fin flared antenna of claim 6, wherein a number of grounded fins is equal to a number of energized fins.

11. The multi-fin flared antenna of claim 10, wherein a grounded fin and a corresponding energized fin comprise a fin pair, and a sub-slot is associated with each fin pair.

12. The multi-fin flared antenna of claim 11, wherein a sub-slot comprises a plurality of steps, each step having a height and a width.

13. The multi-fin flared antenna of claim 12, wherein a sub-slot associated with a first fin pair is different from a second sub-slot associated with a second fin pair.

14. A multi-fin flared antenna, comprising:

a grounded prong having a lower portion and an upper portion;

an energized prong having a lower portion and an upper portion; and a slot between the upper portion of the grounded prong and the upper portion of the energized prong;

wherein the upper portion of the grounded prong comprises a plurality of spaced apart parallel grounded fins and the upper portion of the energized prong comprises a plurality of spaced apart parallel energized fins.

15. The multi-fin flared antenna of claim 14, wherein a number of grounded fins is equal to a number of energized fins.

16. The multi-fin flared antenna of claim 15, wherein a grounded fin and a corresponding energized fin comprise a fin pair, and a sub-slot is associated with each fin pair.

17. The multi-fin flared antenna of claim 16, wherein a sub-slot comprises a plurality of steps, each step having a height and a width.

18. The multi-fin flared antenna of claim 17, wherein a sub-slot associated with a first fin pair is different from a second sub-slot associated with a second fin pair.

19. The multi-fin flared antenna of claim 16, wherein a height of a first fin pair is different from a height of a second fin pair.

* * * * *